US005885928A

United States Patent [19]

Hirano et al.

[11] Patent Number: 5,885,928

[45] Date of Patent: Mar. 23, 1999

[54] COMPOSITE THERMAL TRANSFER SHEET AND THERMAL TRANSFER IMAGE-RECEIVING SHEET

[75] Inventors: Toshifusa Hirano; Masafumi Hayashi, both of Tokyo-to, Japan

[73] Assignee: Dai Nippon Printing Co., Ltd., Tokyo-To, Japan

[21] Appl. No.: 867,291

[22] Filed: Jun. 2, 1997

[30] Foreign Application Priority Data

Jun. 3, 1996 [JP] Japan ..... 8-160448

[51] Int. Cl.[6] ..... B41M 5/38

[52] U.S. Cl. ..... 503/227; 428/195; 428/484; 428/488.1; 428/488.4; 428/913; 428/914

[58] Field of Search ..... 8/471; 428/195, 428/484, 488.1, 488.4, 913, 914; 503/227

[56] References Cited

U.S. PATENT DOCUMENTS 5,264,279 11/1993 Imamura et al. ..... 428/323
5,654,080 8/1997 Hayashi et al. ..... 428/198

*Primary Examiner*—Bruce H. Hess
*Attorney, Agent, or Firm*—Ladas & Parry

[57] ABSTRACT

A composite thermal transfer sheet 100 comprising: a thermal transfer film 10 comprising a base film 11 and a heat-fusible ink layer 13 formed on the base film 11; and a thermal transfer image-receiving sheet 20 comprising a substrate 21 and at least one receptor layer 22 formed on the substrate 21, the thermal transfer film 10 and the thermal transfer image-receiving sheet 20 being peelably bonded at the sides of the heat-fusible ink layer 13 and the receptor layer 22 respectively, the receptor layer 22 including colorant and binder, the binder including pyroxyline or polyamide resin.

7 Claims, 2 Drawing Sheets

COMPOSITE THERMAL TRANSFER SHEET AND THERMAL TRANSFER IMAGE-RECEIVING SHEET

BACKGROUND OF THE INVENTION

1. Field of the Invention

The present invention relates to a so-called composite thermal transfer sheet constructed of a thermal transfer image-receiving sheet having a receptor layer on a substrate and a thermal transfer film having a heat-fusible ink layer on a base film, peelably bonded to each other, such that the receptor layer of the thermal transfer image-receiving sheet and the heat-fusible ink layer of the thermal transfer film are peelably attached to each other.

The present invention also relates to a thermal transfer image-receiving sheet having a receptor layer on a substrate to be used for the composite thermal transfer sheet.

2. Description of the Related Art

Recently, a thermal transfer medium of a heat-fusible transfer type is often used for output prints of a computer, a processor or the like.

As one example of such a thermal transfer medium of the heat-fusible transfer type, a thermal transfer film of the heat-fusible transfer type is constructed of: a base film composed of a plastic film having a thickness of about 3[$\mu$m] to 20[$\mu$m] such as a polyester film or a cellophane film; and a heat-fusible ink layer, which is coated on the base film and which is composed of a mixture of vehicle (e.g. wax) and colorant such as pigment or dye.

When printing is affected on a thermal transfer image-receiving sheet using the aforementioned thermal transfer film, the thermal transfer film is supplied from a roll thereof, while a continuous or cut-sheet-like thermal transfer image-receiving sheet is also supplied, so that the former and the latter are superposed on each other on a platen. Then, in such a state, heat is applied to the thermal transfer film from the back side surface thereof by a thermal head, so that the heat-fusible ink layer of the thermal transfer film is melted and transferred to the thermal transfer image-receiving sheet. Therefore, a desired image is formed on the thermal transfer image-receiving sheet.

However, if the aforementioned thermal transfer film would be applied to a thermal printer used for printing on a heat-sensitive color-forming paper, a problem is posed as followings. Namely, the heat-sensitive color-forming paper develops coloring by itself (i.e. without the thermal transfer film). Therefore, the thermal printer used for printing on a heat-sensitive color-forming paper does not have any means for transporting the thermal transfer film. Thus, the thermal transfer film cannot be used in the aforementioned thermal printer.

In order to solve the aforementioned problem, the composite thermal transfer sheet is proposed. The composite thermal transfer sheet is constructed by peelably bonding a thermal transfer film and a thermal transfer image-receiving sheet. The thermal transfer film is constructed of a base film and a heat-fusible ink layer formed thereon, and a thermal transfer image-receiving sheet is constructed of, for example, a plain paper, a synthetic paper, a coated paper and so on. Further, the thermal transfer film and the thermal transfer image-receiving sheet are peelably bonded through a temporary adhesive layer formed on the heat-fusible ink layer of the thermal transfer film. Furthermore, in the composite thermal transfer sheet, the thermal transfer film is peeled from the thermal transfer image-receiving sheet after printing, and thus, an image is formed on the thermal transfer image-receiving sheet.

Here, The demand for various multicolor printing matter is increasing. Thus, it is required to provide a composite thermal transfer sheet for multicolor printing, which has a colored thermal transfer image-receiving sheet. By using the aforementioned composite thermal transfer sheet for multicolor printing, the contrast between the heat-fusible ink and the colored thermal transfer image-receiving sheet can be improved, and the visibility of the printing matter is improved, so that the attractive printing matter is produced.

However, in this case, If a colored sheet such as colored plain paper on the market would be used as the colored thermal transfer image-receiving sheet of the composite thermal transfer sheet for multicolor printing, the concentration of a letter printed on the colored sheet is not uniform, and the unevenness of transfer is occurred, so that the printing quality is not stable. Further, there are not many kinds of color of the colored sheet, so that it is difficult to obtain the color sheet which has a desired or favorite color.

Furthermore, there is a problem of the background pollution, which the ink included in the thermal transfer film is removed and adhered onto a blank portion of the thermal transfer image-receiving sheet, when composite thermal transfer sheet is preserved for a long period, or preserved in a condition of high temperature. If the colored thermal transfer image-receiving sheet is used, since the contrast between the heat-fusible ink and the thermal transfer image-receiving sheet is improved, the background pollution is more noticeable in the colored thermal transfer image-receiving sheet. Therefore, a preservation environment and a preservation period are considerably restricted.

SUMMARY OF THE INVENTION

It is therefore an object of the present invention to provide a composite thermal transfer sheet and a thermal transfer image-receiving sheet, in which the suitable adhesive property to peelably bond a thermal transfer film and the thermal transfer image-receiving sheet can be obtained, and in which the ink reception capability can be improved, and on which various desired color can be put, and in which a clear image can be obtained when the composite thermal transfer sheet is preserved for a long period or preserved in a condition of high temperature.

According to the present invention, the above mentioned object can be achieved by a composite thermal transfer sheet constructed of: a thermal transfer film constructed of a base film and a heat-fusible ink layer formed on the base film; and a thermal transfer image-receiving sheet constructed of a substrate and at least one receptor layer formed on the substrate, and the thermal transfer film and the thermal transfer image-receiving sheet being peelably bonded at the sides of the heat-fusible ink layer and the receptor layer respectively, the receptor layer including colorant and binder, the binder including pyroxyline or polyamide resin.

Thus, since the receptor layer of the thermal transfer image-receiving sheet includes colorant, the thermal transfer image-receiving sheet is colored. Therefore, the thermal transfer sheet for multicolor printing can be obtained. Further, since the receptor layer includes binder, which is includes pyroxyline or polyamide resin, the ink reception capability of the reception layer and the ability of the dispersion of the colorant included in the receptor layer are improved, and the background pollution can be prevented, so that the ability of the preservation is improved.

Further, in the composite thermal transfer sheet of the present invention, wherein the amount of pyroxyline or polyamide resin included in the receptor layer is in the range of 30[%] to 80[%] with respect to the total amount of the binder included in the receptor layer.

Thus, the ink reception capability of the receptor layer is improved, so that the printing concentration is improved. Further, the nonuniformity of transferring and the background pollution can be prevented.

Furthermore, in the composite thermal transfer sheet of the present invention, wherein a glass transition temperature of pyroxyline or polyamide resin included in the receptor layer is in the range of 60[° C.] to 250[° C.].

Thus, the ink reception capability of the receptor layer is improved, and the background pollution can be prevented.

According to the present invention, the above mentioned object can be also achieved by a thermal transfer image-receiving sheet used for a composite thermal transfer sheet, having a substrate; and at least one receptor layer formed on the substrate, being peelably bonded to the thermal transfer film, and including colorant and binder, the binder including pyroxyline or polyamide resin.

The nature, utility, and further feature of this invention will be more clearly apparent from the following detailed description with respect to preferred embodiments of the invention when read in conjunction with the accompanying drawings briefly described below.

DETAILED DESCRIPTION OF THE PREFERRED EMBODIMENTS

Referring to the accompanying drawings, embodiments of the present invention will be now explained.

Figure 1:
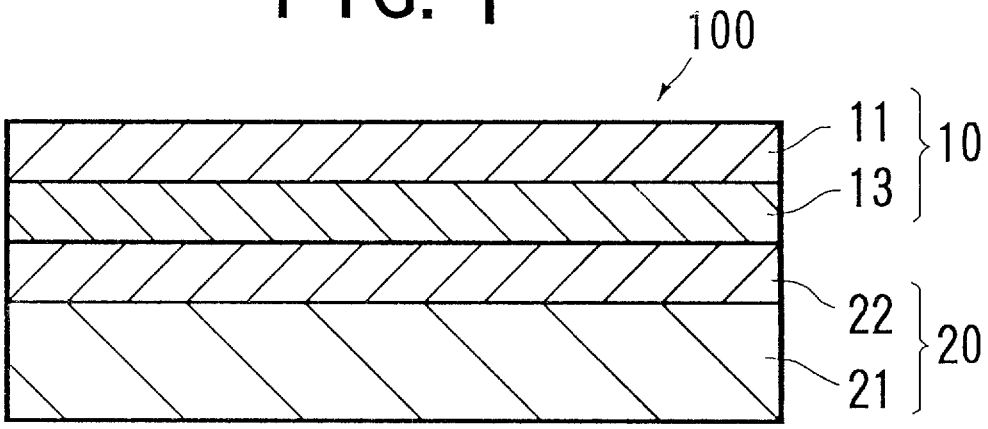
FIG. 1 is a schematic sectional view of the first embodiment of the composite thermal transfer sheet according to the present invention.
Figure 2:
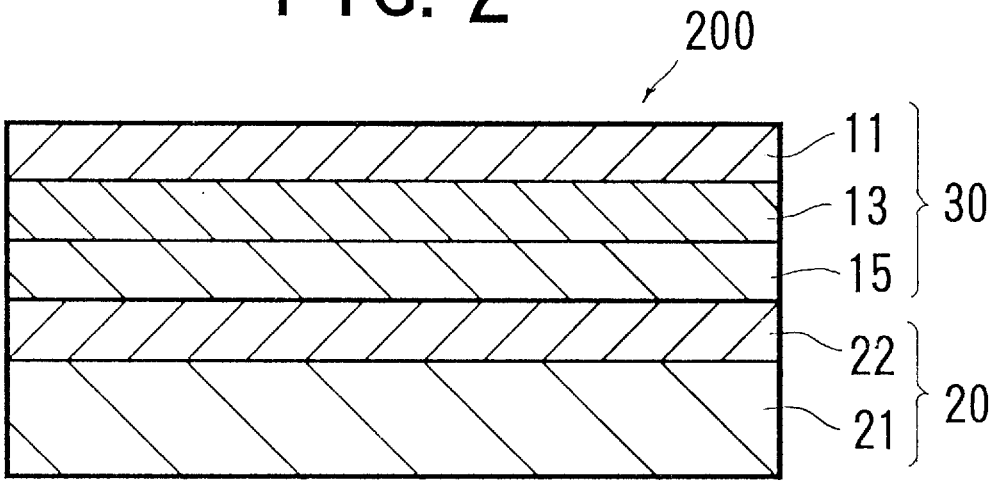
FIG. 2 is a schematic sectional view of the second embodiment of the composite thermal transfer sheet according to the present invention.
Figure 3:
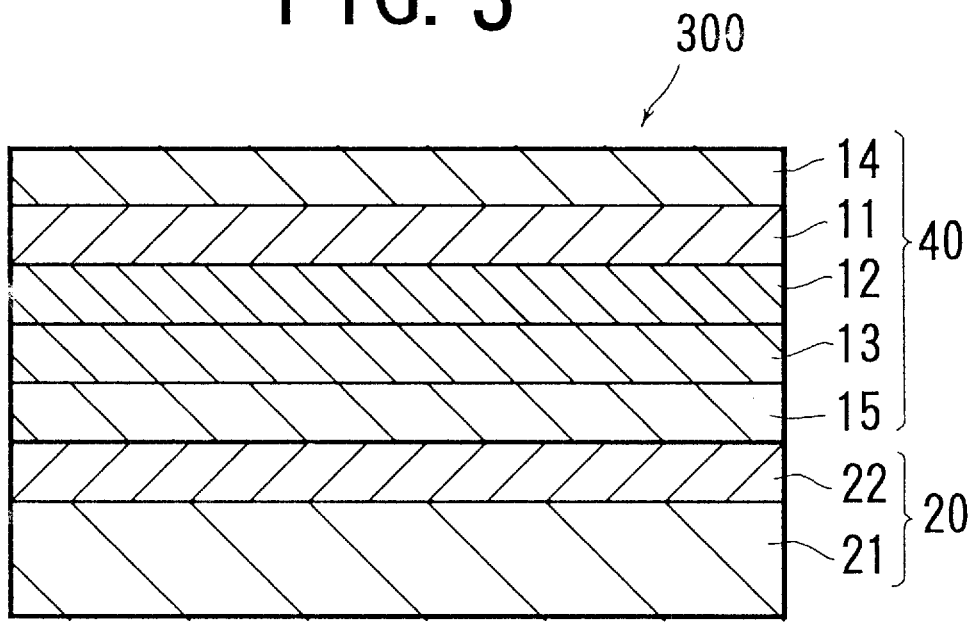
FIG. 3 is a schematic sectional view of the third embodiment of the composite thermal transfer sheet according to the present invention.

Each of FIGS. 1 to 3 is a schematic sectional view of a preferable embodiment of a composite thermal transfer sheet according to the present invention.

In FIG. 1, a composite thermal transfer sheet 100 is the first embodiments of present invention, and this is the most simple embodiment of the present invention. Namely, In FIG. 1, the composite thermal transfer sheet 100 is a so-called thermal transfer sheet of composite type, which is constructed by peelably bonding a thermal transfer film 10 and a thermal transfer image-receiving sheet 20 to each other. The composite thermal transfer sheet 100 is sold on the market as a product in a condition that the thermal transfer image-receiving sheet 20 and the thermal transfer sheet 10 are superposed and both are rolled.

Further, in FIG. 1, the composite thermal transfer film 10 is constructed of a base film 11 and a heat-fusible ink layer 13 formed thereon. On the other hand, the thermal transfer image-receiving sheet 20 is constructed of a substrate 21 and a receptor layer 22 formed thereon. Furthermore, the thermal transfer film 10 and thermal transfer image-receiving sheet 20 are peelably bonded to each other at the sides of the heat-fusible ink layer 13 and the receptor layer 22 respectively.

In FIG. 2, a composite thermal transfer sheet 200 is the second embodiment of the present invention. In FIG. 2, the composite thermal transfer sheet 200 is constructed by peelably bonding a thermal transfer film 30 and the thermal transfer image-receiving sheet 20 to each other. The basic structure of the composite thermal transfer sheet 200 is the same as the composite thermal transfer sheet 100 of the first embodiment, but in the composite thermal transfer sheet 200 of the second embodiment shown in FIG. 2, the temporary adhesive layer 15 is formed on the heat-fusible ink layer 13 of thermal transfer film 30.

In FIG. 3, a composite thermal transfer sheet 300 is the third embodiment of the present invention. In FIG. 3, the composite thermal transfer sheet 300 is constructed by peelably bonding a thermal transfer film 40 and the thermal transfer image-receiving sheet 20 to each other. The basic structure of the composite thermal transfer sheet 300 is the same as the composite thermal transfer sheet 100 of the first embodiment, but in the composite thermal transfer sheet 300 of the third embodiment shown in FIG. 3, a mat layer 12 is formed between the base film 11 and the heat-fusible ink layer 13 of the thermal transfer film 40, and further, a back side layer 14 is formed on the back side surface of the base film 11 of the thermal transfer film 40.

The aforementioned elements of the composite thermal transfer sheets 100, 200 and 300 will be explained in detail as followings.

(Base film)

The base film 11 to be used in the present invention may be the same as that used in the conventional thermal transfer films as they are. However, the base film 11 is not restricted to such a conventional base film, but may also be another base film.

Preferred examples of the base film 11 may include: a plastic film composed of plastic such as polyester, polypropylene, cellophane, polycarbonate, cellulose acetate, polyethylene, polyvinyl chloride, polystyrene, nylon (trade mark), polyimide, polyvinylidene chloride, polyvinyl alcohol, fluorine contained resin, chlorinated rubber, ionomer etc; a paper such as a condenser paper and a paraffin paper; a non-woven fabric; and so on, and a mixture of these materials.

The thickness of the base film 11 may be appropriately changed corresponding to the material constituting it so as to provide suitable strength and thermal conductivity thereof, may be preferably about 2[$\mu$m] to 25[$\mu$m].

(Heat-Fusible Ink Layer)

The heat-fusible ink layer 13 formed on the aforementioned base film 11 contains colorant and binder as principal components, and further can contain additive selected from various additives as the occasion demand.

In case that the thermal transfer film 10, 30 or 40 is used for the purpose of monochrome printing such as black, carbon black may be preferred as the material included in the heat-fusible ink layer 13. However, the material of the heat-fusible ink layer 13 is not restricted to carbon black, but it may be another substance which has a suitable characteristic as a recording material among conventional organic or inorganic pigment. More concretely, the material of the heat-fusible ink layer 13 preferably has a suitable coloring concentration and the characteristic not to be discolored by light, heat, temperature and so on. Further, the material of the heat-fusible ink layer 13 may be another substance which is colorless in the state of non-heating but color is developed by heating. Furthermore, the material may be also the other substance whose color is developed by contacting a substance coated on the thermal transfer image-receiving sheet.

On the other hand, in case that the thermal transfer film 10, 30 or 40 is used for the purpose of multicolor printing, suitable colorant selected from various chromatic color pigment or dye such as yellow, magenta and cyan can be used as the material of the heat-fusible ink layer 13. In addition, the colorant whose color is different from that of the receptor layer 22 is selected.

The contents of the colorant is preferably about 1[wt. %] to 70[wt. %], based on the solid content of the heat-fusible ink layer 13.

In order to improve the thermal conductivity and the ability of heat-fusible transfer, a thermal conductivity substance may be incorporated into the heat-fusible ink. The thermal conductivity substance is, for example, aluminum, copper, tin oxide, molybdenum disulfide, carbonaceous material such as carbon black and so on.

The binder contained in the heat-fusible ink layer 13 is predominantly composed of the wax, and drying oil, resin, mineral oil, and derivatives of cellulose and rubber are preferably incorporated into the binder of the heat-fusible ink layer 13.

Examples of wax may include microcrystalline wax, ester wax, carnauba wax, paraffin wax and so on. In addition, specific examples of the wax may include various kinds thereof such as Fisher-Tropsch wax, various low-molecular weight polyethylene, Japan wax, beeswax, whale wax, insect wax, lanolin, shellac wax, candelilla wax, petrolactum, partially modified wax, fatty acid ester, fatty acid amide and so on. Further, one, two or more kinds of various conventional thermoplastic resin may be mixed within the binder.

Further, in order to achieve the purpose for improving the membrane strength of the heat-fusible ink layer 13, the purpose for adding the adhesive property thereto, the purpose for improving the cohesion thereof and so on, it is preferred to contain thermoplastic elastomer having rubber elasticity as an adhesive substance in the heat-fusible ink layer 13. Examples of thermoplastic elastomer having rubber elasticity may include: synthetic rubber such as ethylene-vinyl acetate copolymer, butadiene rubber, styrene-butadiene rubber, nitrile rubber, nitrile-butadiene rubber, high-styrene rubber, isoprene rubber and acrylic rubber; natural rubber; and so on.

It is especially preferred to adopt ethylene-vinyl acetate copolymer, styrene-butadiene rubber and/or acrylonitrile-butadiene rubber among aforementioned thermoplastic elastomer in order to improve the qualification of printing. In order to achieve the aforementioned purposes with respect to the heat-fusible ink layer 13, the contents of aforementioned thermoplastic elastomer is at least 1[wt. %] to 50[wt. %], based on the solid content of the heat-fusible ink layer 13. It will especially exhibit a suitable effect when the contents of the thermoplastic elastomer is 5[wt. %] to 40[wt. %]. If the contents of the thermoplastic elastomer is less than 1[wt. %], the cohesion of the heat-fusible ink layer 13 is not enough, so that the printing quality is easily degraded. On the other hand, if the contents of the thermoplastic elastomer is more than 50[wt. %], the membrane strength of the heat-fusible ink layer 13 becomes so large that the resolution of printing is degraded.

The tensile strength (JIS K6301) of the aforementioned thermoplastic elastomer having rubber elasticity is preferably not less than 1[kg/cm$^2$] and not more than 100[kg/cm$^2$]. If the tensile strength is less than 1[kg/cm$^2$] or more than 100[kg/cm$^2$], the printing quality is degraded.

The glass transition temperature Tg of the thermoplastic elastomer having rubber elasticity is preferably in the range of −10[° C.] to 40[° C.]. If Tg is less than −10[° C.], the adhesive strength between the base film 11 and the heat-fusible ink layer 13 is so high that it is difficult to separate the base film 11 and the heat-fusible ink layer 13. If Tg is more than 40[° C.], the membrane strength is so weak that, for example, the heat-fusible ink layer 13 is removed and adhered onto a blank portion of the thermal transfer image-receiving sheet 20 when the thermal transfer film 10, 30 or 40 and the thermal transfer image-receiving sheet 20 are peelably bonding to each other, i.e., the background pollution is easily occurred.

The heat-fusible ink layer 13 is formed on the base film 11 by a method as explained below. Namely, the binder that predominantly contains the aforementioned wax is melted and mixed with the other necessary components, and thus, the melted liquid is produced. Then, this melted liquid is coated on the base film 11, and the heat-fusible ink layer 13 is formed by a general hot melt coating. On the other hand, the heat-fusible ink layer 13 is formed on the base film 11 by another method as explained below. Namely, the binder that predominantly contains the aforementioned wax is emulsificated or dispersed in aquosity medium, which may contain alcohol, to be emulsion. Further, colorant and the aquosity dispersoid of thermoplastic elastomer are mixed with this emulsion, and thus the emulsion ink is prepared. Then, this emulsion ink is coated on the base film 11 by a forming method such as photogravure, screen process printing, the reverse or direct roll coating process using a wraparound gravure plate and so on, and then, the coated base film 11 is dried. Therefore, the heat-fusible ink layer 13 is formed. The thickness of the heat-fusible ink layer 13 formed by these methods is normally about 0.3[μm] to 10[μm].

(Mat Layer)

The mat layer 12 may be formed between the base film 11 and the heat-fusible ink layer 13 as shown in FIG. 3, because of the reason explained below.

Namely, as there is generally gloss on the surface of printing matter, it looks beautiful but it is sometimes difficult to read the letters printed on the printing matter. Therefore, mat printing is sometimes preferred. In this case, the mat layer 12 is formed between the base film 11 and the heat-fusible ink layer 13, as described in the application proposed by the applicant (Japanese Patent Application No. 58-208306). Namely, inorganic pigment such as silica, calcium carbonate and carbon black is dispersed in a desired solvent, and thus, the liquid is produced. Then, the liquid is coated on the base film 11 as the binder, and it is dried. Therefore, the mat layer 12 is formed.

The thickness of the mat layer 12 is preferably about 0.1[μm] to 10[μm]. If the thickness of the mat layer 12 is less than 0.1[μm], the ability of the mat layer is not enough, i.e. mat printing is not sufficient. If the thickness of the mat layer 12 is more than 10[μm], the high energy of printing is needed.

The mat layer 12 is formed by the method selected from the photogravure process, the gravure reverse roll coating process, the roll coat process and so on.

(Back side layer)

As shown in FIG. 3, the back side layer 14 may be formed on the other side of the base film 11, i.e., the opposite surface of that on which the heat-fusible ink layer 13 is formed, in order to prevent the adhesion of a thermal head of a printer and to improve the ability of slide.

The back side layer 14 is formed by using the binder including slide agent, surface active surfactant (or surfactant), inorganic particles, organic particles and so on.

Examples of the binder to be used for the back side layer 14 may include: cellulose type resin such as ethylene cellulose, hydroxy ethyl cellulose, hydroxy propyl cellulose, methyl cellulose, cellulose acetate, butyric cellulose acetate and pyroxyline; vinyl type resin such as polyvinyl alcohol, polyvinyl acetate, polyvinyl butyral, polyvinyl acetal, polyvinyl pyrrolidone, acrylic resin, polyacrylamide and acrylonitrile-styrene copolymer; polyester resin, polyurethane resin; silicon denaturation or fluorine denaturation urethane resin; melanin resin; urea resin; and so on. Among these, the resin having a plurality of reactivity groups such as hydroxyl groups is selected, and the selected resin is used with the bridging (or cross linking) agent such as polyisocyanide. In this manner, it is preferred that the bridging resin is used for the back side layer 14.

The back side layer 14 is formed by the method explained below. Namely, the binder including slide agent, surface active surfactant, inorganic particles, organic particles, pigment and so on, is melted and disperse in the desired solvent, and thus, the coating liquid is produced. Then, this coating liquid is coated on the base film 11 by a general coating method such as a gravure coater, a roll coater, a wire bar, and it is dried. Therefore, the back side layer 14 is formed.

The thickness of the back side layer 14 is normally about 0.01[μm] to 10[μm].

Next, the thermal transfer image-receiving sheet 20, which is peelably bonded to the thermal transfer film 10, 30 or 40, as shown in FIGS. 1 to 3, will be explained.

(Substrate)

The material of the substrate 21 is not especially restricted. Preferable examples of the substrate 21 may include: a synthetic paper of polyolefine type and polystyrene type; a paper such as a wood free paper, an art paper, a coated paper, a cast-coated paper, a wall-paper, a lining paper (or backing paper), a synthetic resin or emulsion impregnation paper, a synthetic rubber latex impregnation paper, a synthetic resin internally-added paper, and a board; and a transparent or opaque plastic material such as polyester, polyvinyl chloride, polyvinylidene chloride, polyurethane, polyvinyl alcohol, polypropylene, polyethylene, polystyrene, ethylene-vinyl acetate copolymer, ethylene-ethyl acrylate copolymer, ethylene-acrylic acid copolymer, methyl pentene polymer, polyimide, polyamide, fluororesin and so no. Further, a white opaque film or a foamed sheet composed of the material, which white pigment and filler are incorporated into the aforementioned plastic material, can be used for the substrate 21.

Further, the transparent plastic film to be used for an OHP (Over Head Projector) may be used for the substrate 21 of the thermal transfer image-receiving sheet 20.

Furthermore, a layered product, which is formed of the combination of the aforementioned plastic materials, may be used for the substrate 21. In such a case, the combination of a cellulosic fiber paper and a synthetic paper or the combination of a cellulosic fiber paper and a plastic film is representative.

The thickness of the substrate 21 is changed in correspondence with the selected material and the production method, but it is normally 25[μm] to 500[μm], and preferably, 50[μm] to 150[μm].

(Receptor Layer)

The receptor layer 22 is formed on the aforementioned substrate 21 as shown in FIGS. 1 to 3. The receptor layer 22 is to receive the ink transferred from the aforementioned heat-fusible ink layer 13 of the thermal transfer film 10, 30 or 40. The receptor layer 22 includes resin and colorant.

The receptor layer 22 of the present invention is constructed of at least one layer, and the layer (or one of a plurality of layers), which is in contact with the heat-fusible ink layer 13 of the thermal transfer film 10, includes the binder which is composed of pyroxyline (nitrocellulose) or polyamide resin having a glass transition temperature Tg of 60[° C.] to 250[° C.] in the amount of 30[%] to 80[%] with respect to the total amount of the binder.

As mentioned above, since the kind of resin used for the receptor layer 22 is restricted, and the glass transition temperature Tg of the resin and the percentage content of the resin are specified, the thermal transfer image-receiving sheet 20 having a good ink reception capability is obtained. Therefore, according to the thermal transfer image-receiving sheet 20, a clearly image can be obtained in a condition that the thermal transfer sheet 100, 200 or 300 is preserved for a long period, or preserved in a condition of high temperature.

Concretely, since pyroxyline or polyamide resin is selected from various kinds of resin so as to use it for the receptor layer 22, the ink reception capability of the receptor layer 22 is improved, the dispersibility of colorant included therein is also improved, and the background pollution, which is occurred by the preservation for a long period of the preservation in a condition of high temperature, can be prevented.

Further, since the glass transition temperature Tg of resin used for the receptor layer 22 is determined to be 60[° C.] to 250[° C.], the background pollution can be prevented and the ink reception capability of the receptor layer 22 is improved. If Tg is less than 60[° C.], the background pollution is easily occurred when the thermal transfer sheet 100, 200 or 300 is preserved for a long period, or preserved in a condition of high temperature. If Tg is more than 250[° C.], the ink reception capability is degraded.

Furthermore, since the amount of pyroxyline or polyamide resin included in the binder of the receptor layer which is in contact with the heat-fusible ink layer 13 is 30[%] to 80[%] with respect to the total amount of the binder, the background pollution can be prevented and the ink reception capability of the receptor layer 22 is improved. If the amount of pyroxyline or polyamide resin is less than 30[%], the background pollution is easily occurred when the thermal transfer sheet 100, 200 or 300 is preserved for a long period, or preserved in a condition of high temperature. If the amount of pyroxyline or polyamide resin is more than 80[%], the ink reception capability and the printing concentration are degraded, and the nonuniformity of transferring is occurred, so that the printing quality is degraded.

Further, the receptor layer 22 includes resin other than pyroxyline or polyamide resin, and the resin has the good ink reception capability. Preferable examples of the resin may include: acrylic copolymer such as ethylene-vinyl acetate copolymer, vinyl chloride-vinyl acetate copolymer, acrylonitrile-butadiene rubber, styrene-acrylic and so on; polyester; polyvinyl alcohol; polyurethane; styrene-butadiene rubber; acrylic resin; natural-processing resin; petroleun resin; and so on. Further, the wax such as carnauba wax, paraffin and so on are preferred as the material used for the receptor layer 22.

The colorant included in the receptor layer 22 performs a function to color the thermal transfer image-receiving sheet 20. The colorant is selected such that the color is different from that of colorant included in the heat-fusible ink layer 13. Examples of the colorant may include: yellow hue such as fast yellow, disazo yellow, permanent yellow, azo yellow of condensation type, monoazo yellow of acetonitrile type and isoindolenone yellow; orange hue such as disazo orange and vulcan orenge; red hue such as permanent carmine, brilliant fast scarlet, pyrazolone red, watchung red, lithol red, lake red, brilliant carmine, iron oxide red, quinacridone magenta, red of condensation type, naphtohol AS red and isoindolenone red; violet hue such as methyl violet lake, quinacridone violet, dioxazine violet and insoluble azo violet; blu hue such as phthalocyanine blue, fast sky blue, alkali blue toner, iron blue and ultramarine blue; green hue such as phthalocyanine green; and so on. The combination of two or more these pigments may be used for the colorant.

The mixing ratio of the colorant and resin (or wax) included in the receptor layer 22 is preferably 10:(0.1 to 20). Further, among resin, so-called latex which have rubber elasticity, such as NBR, SBE or the like, is preferably used. These latex has strong cohesion. Especially, among these latex, the latex having a glass transition temperature Tg of −20[° C.] to 30[° C.] is preferred. If Tg is less than −20[° C.], the receptor layer 22 becomes so soft that the background pollution is easily occurred. If Tg is more than 30[° C.], the receptor layer 22 is so hard that the ink reception capability is degraded.

Further, in order to compensate for and improve the ability of the coloring of the aforementioned colorant included in the receptor layer 22, fluorescent dye or pearl pigment may be used for the receptor layer 22 with the aforementioned colorant together.

As the colorant included in the receptor layer 22 is used for coloring the receptor layer 22, the contents of the colorant are changed corresponding to the selected colorant, and the contents are normally about 5[wt. %] to 50[wt. %].

The thickness of the receptor layer 22 is about 0.5[μm] to 30[μm]. If the thickness of the receptor layer 22 is too thin, the fixation of the heat-fusible ink is degraded, and the coloring sense is also degraded. If the thickness of the receptor layer 22 is too thick, the membrane strength is so weak that the receptor layer 22 is removed and adhered onto the thermal transfer film side when the thermal transfer film is peeled off from the thermal transfer image-receiving sheet.

The receptor layer 22 is formed by a method as followings. Namely, colorant and resin (or wax) is melted or dispersed, and thus, the coating liquid is prepared. Then, this coating liquid is coated on the substrate 21 by a method such as photogravure, screen process printing, the reverse or direct roll coating process using a wraparound gravure plate and so on, and the coated substrate 21 is dried. Therefore, the receptor layer 22 is formed on the substrate 21.

Further, in order to improve the adhesive between the receptor layer 22 and substrate 21, the receptor layer 22 may be formed on the substrate 21 through the primer layer, i.e., the primer layer may be formed between the receptor layer 22 and the substrate 21. Examples of the primer layer may include acrylic resin, nylon resin, vinyl chloride-vinyl acetate copolymer, polyester resin, urethane resin and so on. The primer layer is formed by the method such as gravure coat, gravure reverse coat, roll coat and knife coat. The primer layer, in the dry condition, may have the thickness of 0.1[μm] to 5[μm]. Further, curing agent (or hardener) may be incorporated into the primer layer or self-bridging may be done with respect to the material of the primer layer, so that the membrane strength can be improved.

The aforementioned thermal transfer image-receiving sheet 20 and the thermal transfer film 10, 30 or 40 are temporarily (peelably) bonded at the sides of the heat-fusible ink layer 13 and the receptor layer 22 respectively, as shown in FIGS. 1 to 3. In the first embodiment shown in FIG. 1, the heat-fusible ink layer 13 and the receptor layer 22 are peelably bonded to each other by the adhesive property which is added to the heat-fusible ink layer 13 of the thermal transfer film 10.

In the second embodiment shown in FIG. 2 and the third embodiment shown in FIG. 3, the temporary adhesive layer 15 is formed between the receptor layer 22 and the heat-fusible ink layer 13, and both layers are peelably bonded to each other by the temporary adhesive layer 15.

One of various conventional adhesive agents may be used for the temporary adhesive layer 15. The adhesive agent used for the temporary adhesive layer 15 is preferably wax and adhesive resin which the glass transition temperature is low, or wax and thermoplastic particles, whose shape is kept in room temperature but which forms a membrane by heating it.

The adhesive strength of the temporary adhesive layer 15 is preferably in the range of 300[g] to 2000[g] in the measurement condition mentioned below. Namely, the composite thermal transfer sheet 100, 200 or 300 of the present invention is cut into the piece whose size of 25[mm] (width)×55[m] (length), and thus, a sample of the composite thermal transfer sheet is prepared for the measurement. The adhesive strength with respect to the sample, which is measured by using a surface friction measuring device (HEIDEN-17, made by SINTOHKAGAKU) in a condition that the speed of testing rate of stressing (elastic stress rate or rate of straining elapsed time) is 1800[mm/min], is preferably in the range of 300 to 2000[g]. If the adhesive strength is less than 300[g], the adhesive strength between the thermal transfer film 10, 30 or 40 and the thermal transfer image-receiving sheet 20 is so weak that both are easily peeled and wrinkles are formed in the thermal transfer film 10, 30 or 40. If the adhesive strength is more than 2000[g], the adhesive strength is enough, but the heat-fusible ink layer 13 is easily transferred to the thermal transfer image-receiving sheet 20 in a blank thereof, and background pollution is easily occurred in the thermal transfer image-receiving sheet 20.

The aforementioned adhesive resin used for the temporary adhesive layer 15 preferably has the glass transition temperature Tg of −90[° C.] to −50[° C.]. Examples of the adhesive resin may include adhesive resin of a rubber type, adhesive resin of acrylic, adhesive resin of a silicone type or so on. The form of the adhesive resin is not especially restricted, and can be selected from solvent-solution type, aqueous solution type, hot melt type, aquosity and oiliness emulsion type. On the other hand, examples of thermoplastic particles, whose shape is kept in room temperature but which forms a membrane by heating it, may include polyethylene resin, ionomer resin, ethylene-vinyl acetate copolymer and so on. Further, the aforementioned thermoplastic particles has the lowest temperature for forming a membrane of 50[° C.] to 150[° C.].

If the aforementioned adhesive resin is singly used for the adhesive agent of the temporary adhesive layer 15, a good adhesive property is obtained. However, in this case, the peeling ability of the thermal transfer image-receiving sheet 20 becomes insufficient and ununiform. Further, in this case, if an unexpected pressure is applied to the thermal transfer sheet 100, 200 or 300 while the thermal transfer sheet 100, 200 or 300 is produced, preserved or transported, the heat-fusible ink layer 13 of the thermal transfer film 10, 30 or 40 is transferred to the thermal transfer image-receiving sheet 20, so that the background pollution is easily occurred. Furthermore, in this case, the sharpness in cutting or peeling of the layer is degraded. For example, the heat-fusible ink is transferred onto the periphery of the area where heat is applied by a thermal head, so that the definition or resolution of the image formed on the thermal transfer image-receiving sheet 20 is degraded.

The aforementioned problems with respect to the background pollution and the degradation of the sharpness in cutting or peeling of the layer are solved by the following way. Namely, the emulsion of the wax, which is used for the heat-fusible ink layer 13, is added into the aforementioned emulsion adhesive resin, so that the adhesive property of the adhesive agent can be adjusted to a suitable range. Thus, the definition or resolution of the image formed on the thermal transfer image-receiving sheet 20 can be improved, while the aforementined problem of the background pollution can be solved.

The weight ratio of the adhesive resin and the wax is preferably 1:(0.5 to 6). If the weight ratio is out of this range, the aforementioned various problems may be occurred.

The temporary adhesive layer 15 may be formed on the surface of the thermal transfer image-receiving sheet 20. However, in this case, the adhesive property is left on the surface of the thermal transfer image-receiving sheet 20 after the thermal transfer image-receivingsheet20 is peeled off from the thermal transfer film 10, 30 or 40. Thus, it is preferable that the temporary adhesive layer 15 is formed on the surface of the heat-fusible ink layer 13 of the thermal transfer film 10, 30 or 40. In this case, the function of the heat-fusible ink layer 13 is not disturbed by the temporary adhesive layer 15, since the adhesive resin of the temporary adhesive layer 15 is used as an aqueous emulsion. Further, the coating method and the drying method of the emulsion are not especially restricted, and these methods are selected from various conventional methods.

The thickness of the temporary adhesive layer 15 is preferably in the range of 0.1[$\mu$m] to 10[$\mu$m] (the range of 0.05[g/m$^2$] to 5[g/m$^2$] based on the solid content coating amount).

The thermal transfer film 10, 30 or 40 and the thermal transfer image-receiving sheet 20 are peelably bonded by using the adhesive property of the heat-fusible ink layer 13 or the temporary adhesive layer 15, and then, these are rolled. In such a case, the thermal transfer image-receiving sheet 20 may be disposed at the outside of the roll, but the thermal transfer film 10, 30 or 40 may be disposed at the outside. Further, these may be cut into cut-sheets.

EXPERIMENTAL EXAMPLE 1

The embodiments of the present invention is specifically described with reference to EXPERIMENTAL EXAMPLES 1, 2 and 3. In the description appearing below, "parts" and "%" are those by weight unless otherwise noted specifically.

(Composition of Thermal Transfer Film)

The base film of EXPERIMENTAL EXAMPLE 1 is composed of polyethylene terephthalate having the thickness of 4.5[$\mu$m], and the back side layer is formed on the back side surface thereof. Then, the coating liquid for forming the mat layer is coated on the surface of the base film (the opposite side of the back side surface of the base film) in a condition that the amount of the coating liquid is 0.5[g/m$^2$] based on the solid content thereof, and the coated base film is dried in the temperature of 80[° C.] to 90[° C.]. Therefore, the mat layer is formed on the surface of the base film. Further, the heat-fusible ink layer having the following composition is coated on the mat layer by the gravure coating in a condition that the amount of the ink composition is 4[g/m$^2$], based on the solid content thereof, and the coated base film is dried in the temperature of 80[° C.] to 90[° C.]. Therefore, the heat-fusible ink layer is formed, and thus, the thermal transfer film is formed.

| Coating Liquid for Mat Layer | |
|---|---|
| Polyester Resin (Bairon 200, made Toyobou K.K.) | 16 parts |
| Carbon black (Daiyaburakku, made by Mitubishikagaku K.K.) | 24 parts |
| Dispersant | 1.5 parts |
| curing agent | 3 parts |
| methyl ethyl ketone/toluene (1/1) | 60 parts |
| **Ink Composition for Heat-Fusible Ink Layer** | |
| Carbon Black (Daiyaburakku, made by Mitubishikagaku K.K.) | 10 parts |
| Carnauba Wax | 40 parts |
| Acrylonitrile-butadiene rubber (Tg = 4 [°C.]) | 10 parts |
| Ethylene- Vinyl Acetate Copolymer | 10 parts |
| Water | 30 parts |

Next, the aforementioned thermal transfer film and the thermal transfer image-receiving sheet formed by a method explained below are prepared, and the heat-fusible ink layer of the thermal transfer film and the receptor layer of the thermal transfer image-receiving sheet are temporarily (peelably) bonded to each other. Therefore, the thermal transfer sheet of EXPERIMENTAL EXAMPLE 1 is obtained. The bonding is carried out in a condition that the nip temperature is 50[° C.] and the nip pressure is 5[kg/c m$^2$].

(Composition of Thermal Transfer Image-Rceiving Material)

The coated paper (as a substrate) having basis weight of 84.9[g/m$^2$] is prepared, and the receptor layer having the following composition is coated on the coated paper in a condition that the amount of the composition is 1.0[g/m$^2$] based on the solid content thereof. Then, the coated paper, on which the composition of the receptor layer is coated, is dried in the temperature of 50[° C.] to 120[° C.], and thus, the receptor layer is formed on the coated paper. Therefore, the thermal transfer image-receiving sheet is formed.

| Composition for Receptor Layer | |
|---|---|
| Pigment (Permanent yellow) | 17.3 parts |
| Pyroxyline (Tg = 200 [°C.]) | 36.5 parts |
| Urethane Resin (Tg = −20 [°C.]) | 19.2 parts |
| Natural Processing Resin (Tg = 100 [°C.]) | 19.2 parts |
| Polyethylene Wax | 7.7 parts |

EXPERIMENTAL EXAMPLE 2

The composite thermal transfer sheet of EXPERIMENTAL EXAMPLE 2 is formed in the similar condition to EXPERIMENTAL EXAMPLE 1, except that the pigment included in the receptor layer is changed from Permanent Yellow to Phthalocyanine Green.

| Composition for Receptor Layer | |
|---|---|
| Pigment (Phthalocyanine Green) | 17.3 parts |
| Pyroxyline (Tg = 200 [°C.]) | 36.5 parts |
| Urethane Resin | 19.2 parts |

-continued

| Composition for Receptor Layer | |
|---|---|
| (Tg = −20 [°C.]) | |
| Natural Processing Resin (Tg = 100 [°C.]) | 19.2 parts |
| Polyethylene Wax | 7.7 parts |

EXPERIMENTAL EXAMPLE 3

The composite thermal transfer sheet of EXPERIMENTAL EXAMPLE 3 is formed in the similar condition to EXPERIMENTAL EXAMPLE 1, except that Pyroxyline included in the receptor layer is changed to Polyamide Resin having Tg of 80[° C.].

| Composition for Receptor Layer | |
|---|---|
| Pigment (Permanent yellow) | 17.3 parts |
| Polyamide Resin (Tg = 80 [°C.]) | 36.5 parts |
| Urethane Resin (Tg = −20 [°C.]) | 19.2 parts |
| Natural Processing Resin (Tg = 100 [°C.]) | 19.2 parts |
| Polyethylene Wax | 7.7 parts |

EXPERIMENTAL EXAMPLE 4

The composite thermal transfer sheet of EXPERIMENTAL EXAMPLE 4 is formed in the similar condition to EXPERIMENTAL EXAMPLE 1, except that the temporary adhesive layer is formed on the heat-fusible ink layer of the thermal transfer film. More concretely, the temporary adhesive layer having the following composition is coated on the heat-fusible ink layer of the base film used in EXPERIMENTAL EXAMPLE 1 by the photogravure in condition that the amount of the composition is 0.5[g/m$^2$], based on the solid content thereof. Then the coated thermal transfer film is dried in temperature of 90[° C.], and thus, the temporary adhesive layer is formed.

| Composition for Temporary Adhesive Layer | |
|---|---|
| Acrylic Resin Emulsion (Solid Contents: 40 [%]) | 20 parts |
| Carnauba Wax Emulsion (Solid Contents: 40 [%]) | 40 parts |
| isopropyl alcohol/Water (2/1) | 40 parts |

COMPARATIVE SAMPLE 1

The composite thermal transfer sheet of COMPARATIVE SAMPLE 1 is formed in the similar condition to EXPERIMENTAL EXAMPLE 1, except that the thermal transfer image-receiving sheet is changed to a colored coated paper, which has put on the market, and which is has basic weight of 84.9[g/m$^2$].

COMPARATIVE SAMPLE 2

The composite thermal transfer sheet of COMPARATIVE SAMPLE 1 is formed in the similar condition to EXPERIMENTAL EXAMPLE 1, except that Pyroxyline included in the receptor layer is changed to Natural Processing Resin (Tg=100[° C.]).

COMPARATIVE SAMPLE 3

The composite thermal transfer sheet of COMPARATIVE SAMPLE 3 is formed in the similar condition to EXPERIMENTAL EXAMPLE 1, except that Natural Processing Resin and Urethane Resin included in the receptor layer are changed to Polyamide Resin (Tg=80[° C.]).

COMPARATIVE SAMPLE 4

The composite thermal transfer sheet of COMPARATIVE SAMPLE 4 is formed in the similar condition to EXPERIMENTAL EXAMPLE 1, except that Pyroxyline included in the receptor layer is changed to Silicone-Acrylic Resin (Tg=110[° C.]).

Evaluation

The printing sensitivity and the presevability of the composite thermal transfer sheet prepared in each of EXPERIMENTAL EXAMPLES 1 to 3 and COMPARATIVE SAMPLES 1 to 3, is evaluated in the following method and condition. Namely, at first, each of the aforementioned composite thermal transfer sheet is set into a facsimile printer. Next, heat, whose energy is 0.3 mj/dot, is supplied to a thermal head of the facsimile printer, and printing is carried out under a condition of 25[° C.] and 50[%RH]. Then, the thermal transfer image-receiving sheet is peeled from the thermal transfer film, and the desired image is formed on the thermal transfer image-receiving sheet. Thereafter, the evaluation is done as followings.

(Printing Sensitivity)

Under a condition of 25[° C.], 50[%RH], printing is carried out by the facsimile printer, and the desired image is formed on each of the thermal transfer image-receiving sheet. Then, the printing quality is evaluated on the basis of the visual observation.

The result of the evaluation is shown in TABLE 1 by using the following symbols ○ and x.

○: The printing quality is good.

Δ: The printing quality is slightly bad.

x: The printing quality is bad.

(Preservability)

The composite thermal transfer sheets explained in each of EXPERIMENTAL EXAMPLES 1 to 4 and COMPARATIVE SAMPLES 1 to 4 are prepared, and each example or sample is preserved for a month in a condition that it have been rolled, under a preserving condition of 45[° C.] and 85[%RH]. Thereafter, with respect to each of the composite thermal transfer sheets, the printing is carried out. Then, background pollution on the receptor layer of the thermal transfer image-receiving sheet is evaluated on the basis of the visual observation.

The result of the evaluation is shown in TABLE 1 by using the following symbols ○ and x.

○: There is not any background pollution on the receptor layer.

x: There is some background pollution thereon.

(Ability of Handling)

The composite thermal transfer sheets explained in each of EXPERIMENTAL EXAMPLES 1 to 4 and COMPARATIVE SAMPLES 1 to 4 are prepared respectively. Then, with respect to each of those composite thermal transfer sheets, the bonding condition before printing and the peeling condition, which is the condition or feeling when the thermal transfer film is peel off from the thermal transfer image-receiving sheet after printing, are evaluated on the basis of the visual observation and the feeling to touch by hands.

The result of the evaluation is shown in TABLE 1 by using the following symbols ○ and x.

○: Good Condition x: There are some peeling portions in the composite thermal transfer sheet, it is too easy to peel off, or it is too difficult to peel off.

TABLE 1

| | Printing Quqlity | Preservability | Ability of Handling |
|---|---|---|---|
| EXPERIMENTAL EXAMPLE 1 | ○ | ○ | ○ |
| EXPERIMENTAL EXAMPLE 2 | ○ | ○ | ○ |
| EXPERIMENTAL EXAMPLE 3 | ○ | ○ | ○ |
| EXPERIMENTAL EXAMPLE 4 | ○ | ○ | ○ |
| COMPARATIVE SAMPLE 1 | Δ | X | ○ |
| COMPARATIVE SAMPLE 2 | ○ | X | ○ |
| COMPARATIVE SAMPLE 3 | Δ | ○ | ○ |
| COMPARATIVE SAMPLE 4 | X | ○ | X *1 |

*1: It is easily to peel.

In the TABLE 1, it is recognized that each of the examples is improved as compared with each of the samples in view of the printing quality, the preservation and the ability of handling.

According to the aforementioned embodiments of the present invention, the receptor layer 22 which is in contact with the thermal transfer film 10, 30 or 40 includes the binder which is composed of pyroxyline or polyamide resin having a glass transition temperature Tg of 60[° C.] to 250[° C.] in the amount of 30[%] to 80[%] with respect to the total amount of the binder.

Thus, the ink reception capability and the ability of the dispersion of the colorant included in the receptor layer 22 are improved, so that the printing concentration is also improved and the nonuniformity of transferring can be prevented. Further, according to the aforementioned embodiments, the background pollution can be prevented, so that the ability of the preservation is improved.

Further, according to the embodiments, since the receptor layer 22 includes colorant, the thermal transfer image-receiving sheet can be colored. Therefore, the colored thermal transfer sheet can be obtained.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A composite thermal transfer sheet comprising:

a thermal transfer film comprising a base film and a heat-fusible ink layer formed on the base film; and a thermal transfer image-receiving sheet comprising a substrate and at least one receptor layer formed on the substrate, the thermal transfer film and the thermal transfer image-receiving sheet being peelably bonded at the sides of the heat-fusible ink layer and the receptor layer respectively, the receptor layer including colorant and binder, the binder including pyroxyline or polyamide resin.

2. A composite thermal transfer sheet according to claim 1, wherein an amount of pyroxyline or polyamide resin included in the receptor layer is in a range of 30% to 80% with respect to a total amount of the binder included in the receptor layer.

3. A composite thermal transfer sheet according to claim 1, wherein a glass transition temperature of pyroxyline or polyamide resin included in the receptor layer is in a range of 60° C. to 250° C.

4. A composite thermal transfer sheet according to claim 1, wherein the heat-fusible ink layer includes an adhesive substance, and the receptor layer of the thermal transfer image-receiving sheet and the heat-fusible ink layer of the thermal transfer film are peelably bonded to each other by the adhesive substance.

5. A composite thermal transfer sheet according to claim 1, wherein the thermal transfer film further comprises a temporary adhesive layer formed on the heat-fusible ink layer, and the heat-fusible ink layer and the receptor layer are peelably bonded to each other through the temporary adhesive layer.

6. A composite thermal transfer sheet according to claim 1, wherein the thermal transfer film further comprises a mat layer between the base film and the heat-fusible ink layer.

7. A composite thermal transfer sheet according to claim 1, wherein the thermal transfer film further comprises a back side layer formed on a back side surface of the base film.

* * * * *